US005853333A

United States Patent [19]

Patterson

[11] Patent Number: 5,853,333

[45] Date of Patent: Dec. 29, 1998

[54] GIMBALED CUE BRIDGE

[76] Inventor: Thomas D. Patterson, 23 Via Verona Cir., Chico, Calif. 95926

[21] Appl. No.: 919,908

[22] Filed: Aug. 28, 1997

[51] Int. Cl.[6] ..... A63D 15/00

[52] U.S. Cl. ..... 473/42; 473/1; 473/46

[58] Field of Search ..... 473/2, 42

[56] References Cited

U.S. PATENT DOCUMENTS

| | | | |
|---|---|---|---|
| 774,862 | 11/1904 | Blackburn | 473/42 |
| 898,345 | 9/1908 | Farnham | 473/42 |
| 968,187 | 8/1910 | McIntire | 473/42 |

*Primary Examiner*—Theatrice Brown

*Attorney, Agent, or Firm*—Leo R. Carroll

[57] ABSTRACT

The present invention provides a simple and yet fully functional billiard bridge head guiding apparatus which permits angular control of a cue stick at both three axis compound angles and at an adjustable height off the billiard or pool table. Two gimbals are utilized in which the cue holding inner gimbal may be rotated about: 1) the longitudinal axis of a bridge stick; 2) the end longitudinal axis of a straight, bent, or curved elongated shaft; and 3) an axis normal to that of second axis above. In addition, the radial displacement of the gimbal from the first axis above is adjustable by means of shaft elongation. The bridge head does not require use of a custom bridge stick, but rather any cue stick is useable.

14 Claims, 5 Drawing Sheets

GIMBALED CUE BRIDGE

BACKGROUND OF THE INVENTION

1. Technical Field

This invention relates generally to apparatus and methods for playing billiard-type games, including all forms such as pool, billiards, snooker, etc., in which balls on a table are struck by cue sticks. More specifically, the invention is directed toward an improved bridge, which is used to hold a cue stick when the use of hand support is not feasible. These situations usually are caused by obstructions immediately adjacent to the ball which the player desires to strike, and/or by an inability to properly place their hand on the table.

2. Background Art

Existing bridges are often of the open variety and have one or more shaped grooves for cradling the cue. The bridge may be attached to the end of a cue-like bridge stick that allows a player to support the cue at a point on the billiards table at which it would be difficult for him to form a bridge with his hand. U.S. Pat. No. 2,817,525, issued to Niemann, and U.S. Pat. No. 3,576,324, issued to Lareau, disclose examples of such bridges.

Other types of bridges may be gripped directly by the player without the aid of a bridge stick. U.S. Pat. No. 1,105,478, issued to Ames, U.S. Pat. No. 3,851,876, issued to Baker, and U.S. Pat. No. 4,053,153, issued to Josenhans, disclose open bridges that players grip with their fingers. U.S. Pat. No. 2,931,649, issued to Furda provides two semicylindrical resilient members that are biased together to cradle the cue between them and, in another embodiment, by providing a resilient leaf spring that biases the cue against a fixed portion of the bridge.

Previous attempts to provide a bridge extension which forms a secure guiding means at an elevation higher than the length of the bridge have not had great success. Examples of such attempts are U.S. Pat. Nos. 898,345 to Farnham; 968,187 to McIntire; 1,299,720 to Harrison; and 1,482,962 to Banks. An extended vertical position has been obtained by cascading two standard billiard bridges so as to hold them together with one hand. Single handed fixed rectangular designs are available, but they which furnish only two discrete elevations. None of these designs offer a system is which the radial distance from the bridge longitudinal axis is adjustable at extension angles other than vertical.

The closed bridges known in the art do not allow a player to pivot the cue about three axis while a portion of the bridge remains fixed at adjustable angles with respect to the table. These problems and deficiencies of existing art are solved by the present invention in the manner described below.

SUMMARY OF THE INVENTION

The present invention provides a simple yet fully functional bridge head guiding apparatus which permits angular control of the cue stick at three axis compound angles and at an adjustable height off the pool table. A first outer gimbal and a second inner gimbal are adustably disposed at the end of an elongated shaft which is normal to the cue bridge longitudinal axis. Means are provided to rotate the elongated shaft about the cue bridge longitudinal axis so that extension of the elongated shaft results in radial displacement rather than just vertical movement. There will thus be positional displacement components orthogonal to the axis of the elongated shaft and to the cue bridge longitudinal axis. These displacement components, together with the angular degrees of freedom, result in greater "ball look-around" capability than any existing bridge designs.

The prime object of this invention is to provide a gimbaled cue bridge which will permit angular positioning of the cue stick tip with three degrees of freedom.

It is another object of this invention to provide a gimbaled cue bridge having three degrees of angular freedom at displacements above and to the sides of the cue ball.

It is an additional object of this invention to provide a gimbaled cue bridge which is small, light, and easily transportable.

It is a further object of the present invention to provide a gimbaled cue bridge which may be quickly assembled by attachment to any "house" cue stick.

It is still another object of this invention to provide a gimbaled cue bridge which is inexpensively manufactured, is structurally rigid and safe, and will have a reliable long life.

The foregoing, together with other features and advantages of the present invention, will become more apparent when referring to the following specification, claims, and accompanying drawings.

DETAILED DESCRIPTION OF A PREFERRED EMBODIMENT

Figure 1:
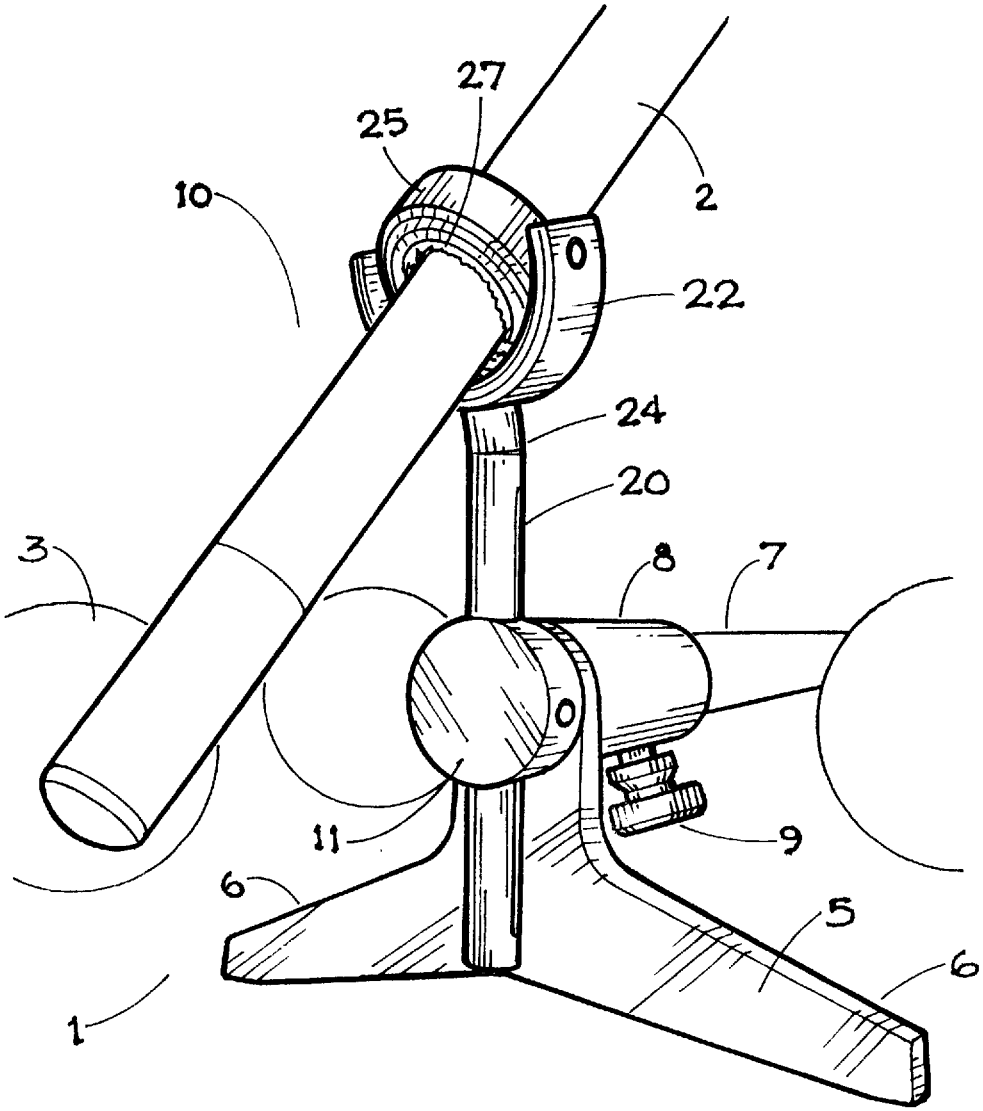
FIG. 1 is a perspective view showing the gimbaled cue bridge of my invention being operationally used on a playing table with a cue stick downwardly striking a billiard ball.

FIG. 1 presents a perspective view of a preferred embodiment of my gimbaled cue bridge 10 being operationally used on playing table 1, with cue stick 2 downwardly striking billiard ball 3. Support for bridge 10 assembly is provided by base means 5 resting on table 1. As depicted in the drawing, base 5 is partially supported by two laterally extended legs 6 in contact with table 1, with additional support provided by bridge stick 7. It will be easily recognized however, that many free standing base embodiments exist, comprising any number of legs, or other table contacting means. Regardless of configuration, the preferred material for base construction is a clear plastic for improved cue tip viewing on deep draw shots such as that shown in FIG. 1.

Figure 2:
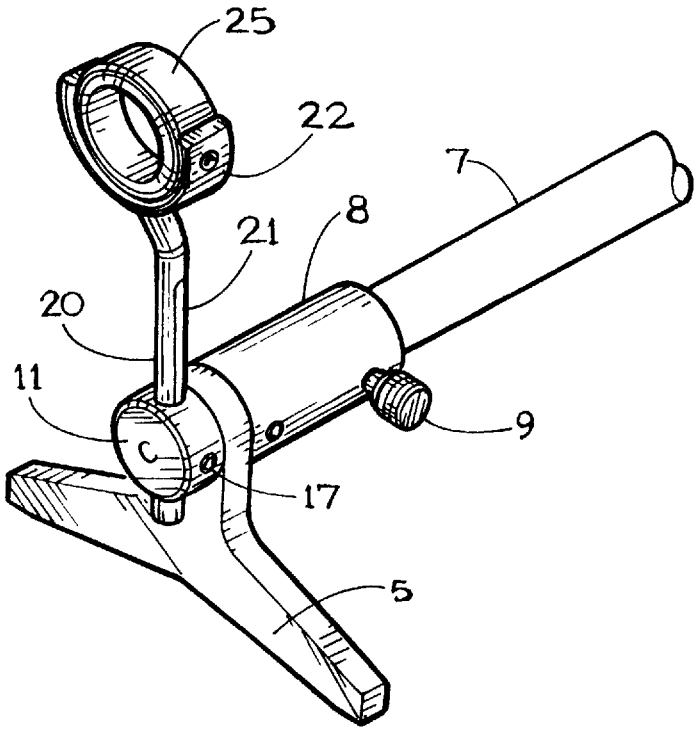
FIG. 2 shows a perspective view of the gimbaled cue bridge of FIG. 1 with the bridge stick collar rotated to expose the set screws, and with the each elevated gimbal axis being in a common plane.

FIG. 2 shows a perspective view of the gimbaled cue bridge of FIG. 1 with the bridge stick collar rotated to expose the set screws, and with elongated shaft 20 rotated to expose groove 21. Each elevated gimbal axis is depicted in a common plane. Bridgestick 7 is connected to base 5, through insertion into the rear end of a barrel shaped hollow collar 8. Securing means such as thumbscrew 9 maintains the collar on the bridge stick 7. In FIGS. 2–5, thumbscrew 7 has been rotated to a horizontal position for clarity, but in actual use it is rotated downward to minimize view occlusion.

Figure 3:
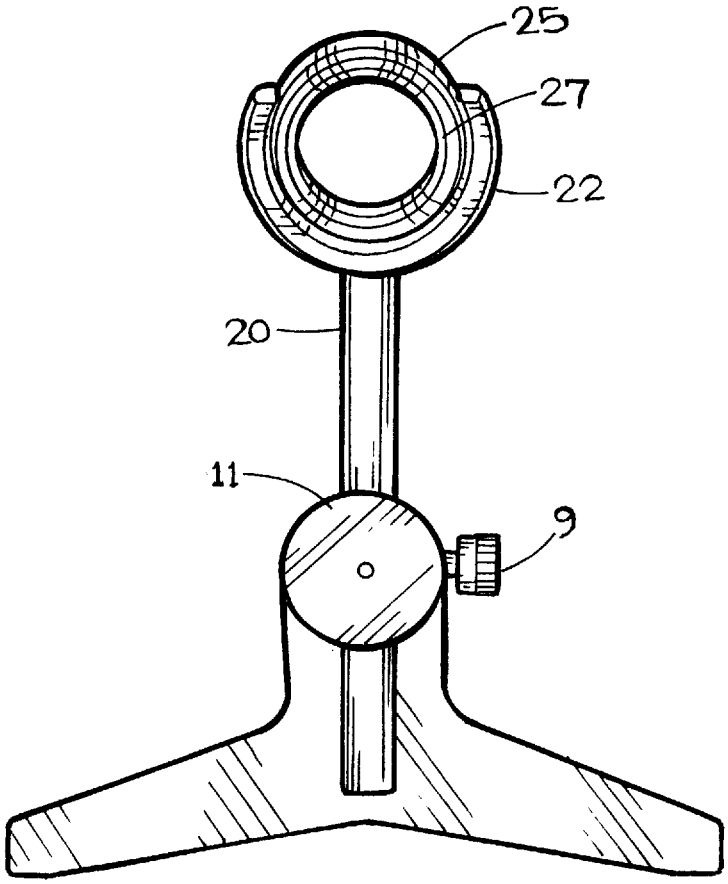
FIG. 3 is a front elevation view of the gimbaled cue bridge of FIG. 2 with the gimbals at a reduced elevation above the base.
Figure 4:
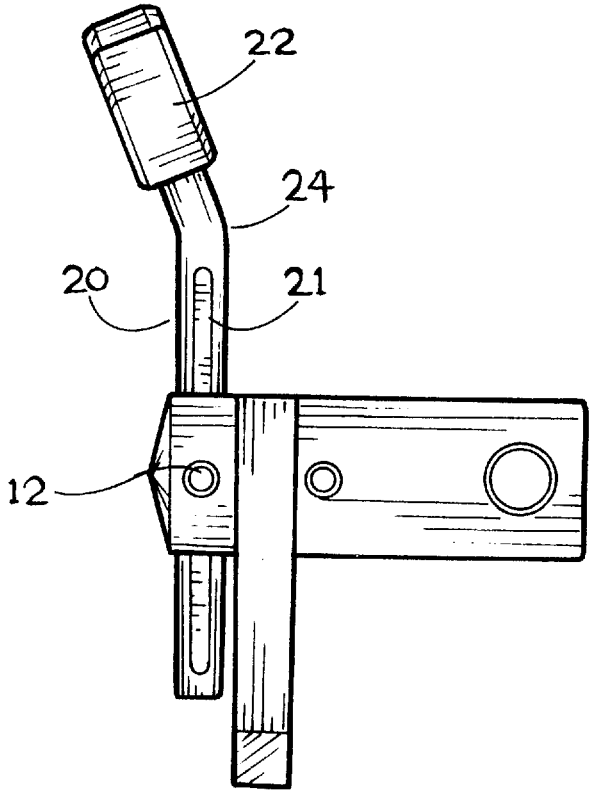
FIG. 4 is a side elevation view of the gimbaled cue bridge of FIG. 3.

FIGS. 3 and 4 show front and side elevation views of the gimbaled cue bridge of FIG. 2 with the gimbals at a reduced elevation above the base.

Figure 5:
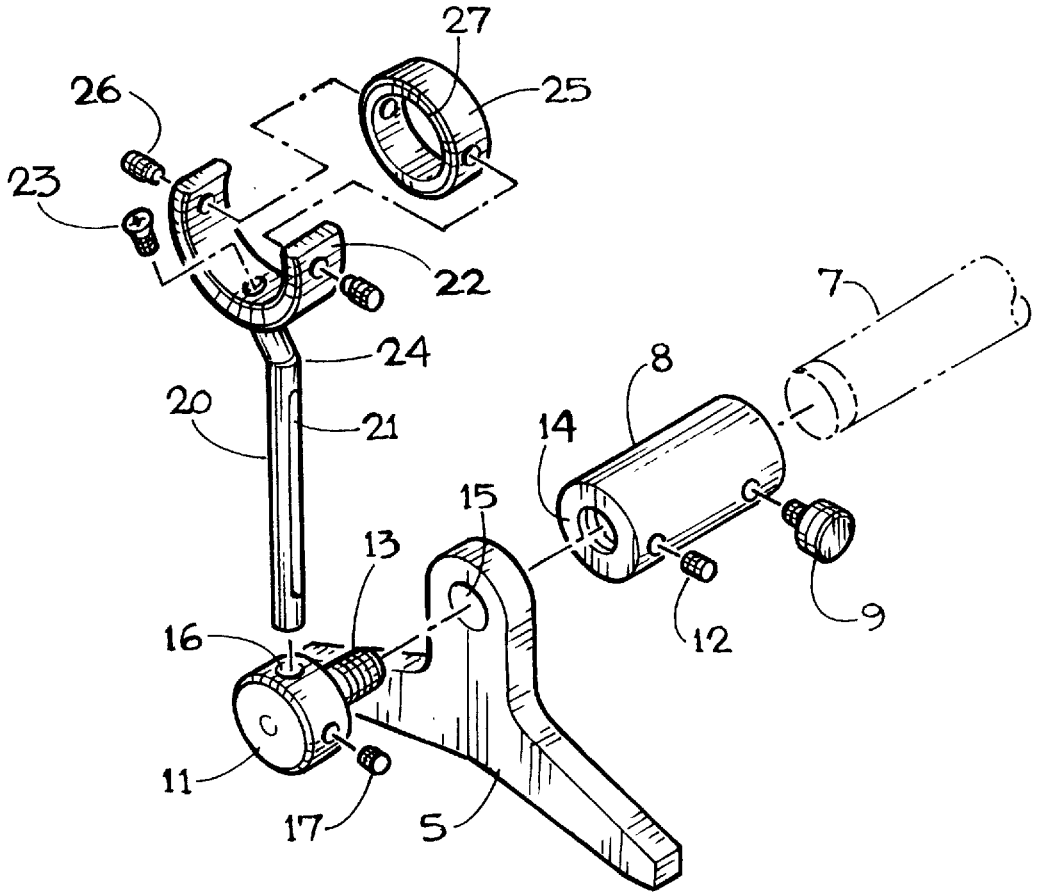
FIG. 5 is an perspective view of my gimbaled cue bridge with it's elements exploded.

FIG. 5 presents a perspective view of the gimbaled cue bridge with it's elements exploded. Front knob screw 11 has a rear threaded portion 13 which mates with tapped hole 14 in the forward end of collar 8 after insertion through aperture 15 in the upper portion of base 5. When properly seated in collar 8, knob screw 11 and the front edge of collar 8 provide a snug fit capture of base 5 through aperture 15. The knob head of screw 11 may thus be rotated and held at an angle about the longitudinal axis of the of collar 8.

The head of knob screw 11 contains an aperture 16 through the head on a line normal to the screw longitudinal axis. Elongated shaft 20 is passed through this aperature 16 and held in place at a desired distance away from the longitudinal axis of screw 11 by means of setscrew 17 and grove 21 in shaft 20.

First angular gimbal means 22 is attached to the threaded upper end of elongated shaft 20 by means of a tapered head bearing screw 23. Although first gimbal means is shown as having an open "U" shape, other closed or non-circular means may be utilized. As this screw 23 is tightened to a snug tapered bearing fit, gimbal 22 may be rotated about the longitudinal axis of the bearing screw. It will be noticed that since the upper portion of shaft 20 is bent forward at point 24 on the shaft, the first gimbal rotation axis will not be collinear with the longitudinal axis of the lower portion of shaft 20. This forward bend at point 24 is made in order to increase the maximum depression angle of cue stick 2, as seen in FIG. 1. Other bend points, or other curvatures of the elongated shaft may of course be utilized.

Referring to FIGS. 1 and 5, second angular gimbal means 25, are supported by and within the first angular gimbal means 22 on an axis normal to the rotational axis of the first angular gimbal means 22. Rotational support means are supplied by bearing screws 26. Although this second gimbal may also have other shapes, a closed circular shape is preferred since this second gimbal must cradle cue stick 2. Since cue stick 2 must also slide through the second gimbal, means of reducing stiction are desirable. This embodiment incorporates an inner liner 27 to perform this function, as well as providing an elastomeric cushion.

When assembled as in FIG. 1, the second cue tip holding gimbal of my invention possesses three degrees of angular freedom. These are: 1) it may be rotated about the longitudinal axis of a bridge stick; 2) it may be rotated about the end longitudinal axis of a straight, bent, or curved elongated shaft; and 3) it may be rotated about an axis normal to that of second axis above. In addition, the radial displacement of the gimbal from the first axis above is adjustable by means of shaft elongation.

The foregoing description and drawings were given for illustrative purposes only, it being understood that the invention is not limited to the embodiments disclosed, but is intended to embrace any and all equivalents, alternatives, modifications and rearrangements of elements falling within the scope of the invention as defined by the following claims.

What I claim is:

1. A gimbaled cue bridge for adjustably supporting a billiard and/or pool cue having striking and hand-holding opposite ends thereon, comprising:

base means for supporting the gimbaled cue bridge on a playing surface;

first angular gimbal means attached to said base means whereby said striking end of said billiard and/or pool cue is supported by and is angularly directed by said first angular gimbal means;

elongated shaft means, said shaft means having a first end connected to said base means and a second end attached to said first angular gimbal means;

means for adjusting the axial length of said elongated shaft means so that positional displacement between said base means and said first angular gimbal means is adjustably controlled;

means for rotating said first angular gimbal means about the longitudinal axis of said elongated shaft means; and means for rotating said elongated shaft means about an axis which is normal to the longitudinal axis of said elongated shaft means and is approximately parallel to said playing surface.

2. A gimbaled cue bridge for adjustably supporting a billiard and/or pool cue, as recited in claim 1, further comprising second angular gimbal means supported by said first angular gimbal means for rotation about an axis normal to said longitudinal axis of said elongated shaft means.

3. A gimbaled cue bridge for adjustably supporting a billiard and/or pool cue, as recited in claim 2, wherein said second angular gimbal means slideably supports and angularly directs said striking end of said billiard and/or pool cue.

4. A gimbaled cue bridge for adjustably supporting a billiard and/or pool cue, as recited in claim 3, wherein said second angular gimbal means provides slideable support for said striking end of said billiard and/or pool cue by means of an elastomeric lining.

5. A gimbaled cue bridge for adjustably supporting a billiard and/or pool cue, as recited in claim 4, wherein said base means further comprises means for supporting bridge stick means.

6. A gimbaled cue bridge for adjustably supporting a billiard and/or pool cue, as recited in claim 5, wherein said base means includes an upper transparent portion so as to reduce visual occlusion by the cue bridge means.

7. A gimbaled cue bridge for adjustably supporting a billiard and/or pool cue, as recited in claim 5, wherein said bridge stick means comprises a billiard and/or pool cue.

8. A gimbaled cue bridge for adjustably supporting a billiard and/or pool cue, as recited in claim 3, wherein said elongated shaft means is curved forward so as to increase the maximum depression angle of the billiard and/or pool cue stick.

9. A method of adjustably supporting a billiard and/or pool cue having striking and hand-holding opposite ends thereon, comprising the steps of:

supporting the gimbaled cue bridge on a playing surface by base means;

attaching first angular gimbal means to said base means whereby said striking end of said billiard-type cue stick is supported by and is angularly directed by said first angular gimbal means;

providing elongated shaft means having a first end connected to said base means and a second end attached to said first angular gimbal means;

adjusting the axial length of said elongated shaft by adjustment means so that positional displacement between said base means and said first angular gimbal means is adjustably controlled;

rotating said first angular gimbal means about the longitudinal axis of said elongated shaft means, and rotating said elongated shaft means about an axis which is normal to the longitudinal axis of said elongated shaft means and is approximately parallel to said playing surface.

10. The method of adjustably supporting a billiard and/or pool cue as recited in claim 9, further comprising the step of providing second angular gimbal means supported by said first angular gimbal means for rotation about an axis normal to said longitudinal axis of said elongated shaft means.

11. The method of adjustably supporting a billiard and/or pool cue as recited in claim 10, further comprising the step of slideably supporting and angularly directing said striking end of said billiard-type cue stick by said second angular gimbal means.

12. The method of adjustably supporting a billiard and/or pool cue cue stick as recited in claim 11, wherein said second angular gimbal means provides slideable supports for said striking end of said billiard and/or pool cue by means of an elastomeric lining.

13. The method of adjustably supporting a billiard and/or pool cue cue stick as recited in claim 12, wherein said base means further comprises means for supporting bridge stick means.

14. A gimbaled cue bridge for adjustably supporting a billiard and/or pool cue having striking and hand-holding opposite ends thereon, comprising:

base means for supporting the gimbaled cue bridge on a playing surface;

first angular gimbal means attached to said base means whereby said striking end of said billiard and/or pool cue is supported by and is angularly directed by said first angular gimbal means;

elongated shaft means, said shaft means having a first end connected to said base means and a second end attached to said first angular gimbal means; and second angular gimbal means supported by said first angular gimbal means for rotation about an axis normal to said longitudinal axis of said elongated shaft means, whereby said billiard and/or pool cue is supported by and is angularly directed about three orthogonal axis.

* * * * *